US011083928B2

(12) United States Patent
Valdez et al.

(10) Patent No.: US 11,083,928 B2
(45) Date of Patent: Aug. 10, 2021

(54) HAND-OVER-HAND FITNESS MACHINE AND METHODS OF USE

(71) Applicant: KONDITION, INC., Santa Monica, CA (US)

(72) Inventors: Daniel Carlos Valdez, Venice, CA (US); Ken Carter, Claremont, CA (US)

(73) Assignee: KONDITION, INC., Santa Monica, CA (US)

( * ) Notice: Subject to any disclaimer, the term of this patent is extended or adjusted under 35 U.S.C. 154(b) by 0 days.

(21) Appl. No.: 16/455,687

(22) Filed: Jun. 27, 2019

(65) Prior Publication Data

US 2020/0101347 A1 Apr. 2, 2020

Related U.S. Application Data

(60) Provisional application No. 62/691,527, filed on Jun. 28, 2018.

(51) Int. Cl.
*A63B 21/00* (2006.01)
*A63B 9/00* (2006.01)
(Continued)

(52) U.S. Cl.
CPC ..... *A63B 21/4035* (2015.10); *A63B 9/00* (2013.01); *A63B 17/00* (2013.01);
(Continued)

(58) Field of Classification Search
CPC ..... A63B 21/4033; A63B 21/4035; A63B 21/4045; A63B 21/4041–4045;
(Continued)

(56) References Cited

U.S. PATENT DOCUMENTS 4,836,535 A * 6/1989 Pearson ..... A63B 21/06 482/101
5,468,199 A * 11/1995 Keeler ..... A63B 9/00 104/62
7,011,606 B2 * 3/2006 Zngf ..... A63B 9/00 482/37

(Continued)

OTHER PUBLICATIONS

Screenshots from YouTube video titled "Reverse Banded Smith Incline Press," uploaded by user "Mark Dugdale" on Mar. 8, 2018, 5 pages, retrieved from Internet: https://www.youtube.com/watch?v=NFhRQ-84yP4 (Year: 2018).*

*Primary Examiner* — Megan Anderson
*Assistant Examiner* — Kathleen Vermillera
(74) *Attorney, Agent, or Firm* — Ferguson Case Orr Paterson

(57) ABSTRACT

An exercise machine. The machine includes a frame with front and rear upper support beams. Guide rails span between the two support beams and are connected thereto. Right and left handles are configured to slide back and forth along the length of the guide rails between the front and rear support beams. During operation of the machine, a user grabs the handles and moves them back and forth in a swinging motion that mimics traversing a set of monkey bars. The guide rails may be arranged in a non-parallel configuration to provide a more natural path for the user's hands during operation and to reduce unwanted stress on the user's shoulders by limiting handle movement along the path to accommodate a more comfortable range of motion.

15 Claims, 10 Drawing Sheets

(51) Int. Cl.
*A63B 23/035* (2006.01)
*A63B 17/00* (2006.01)
*A63B 23/12* (2006.01)

(52) U.S. Cl.
CPC ..... *A63B 23/03541* (2013.01); *A63B 23/12* (2013.01); *A63B 2009/006* (2013.01); *A63B 2208/029* (2013.01)

(58) Field of Classification Search
CPC ..... A63B 21/15; A63B 21/154; A63B 9/00; A63B 23/03541; A63B 23/12; A63B 23/03516; A63B 23/03533; A63B 17/00; A63B 2208/029; A63B 2009/006; A63B 22/201; A63B 22/02; A63B 2225/093; A63B 7/02; A63B 22/0002; A63B 22/203; A63B 22/20; A63B 2022/0041; A63B 244/18–19
USPC ..... 104/62
See application file for complete search history.

(56) References Cited

U.S. PATENT DOCUMENTS

| | | | | |
|---|---|---|---|---|
| 7,063,651 | B2 * | 6/2006 | Kerry | A63B 69/0057 482/140 |
| 7,094,185 | B2 * | 8/2006 | Greenland | A63B 21/06 482/100 |
| 7,497,815 | B1 * | 3/2009 | Caden | A63B 21/151 482/135 |
| 7,998,043 | B2 * | 8/2011 | Zhou | A63B 22/203 482/139 |
| 8,979,717 | B2 * | 3/2015 | Glickstein | A63B 23/1218 482/96 |
| 9,421,413 | B2 * | 8/2016 | Staten | A63B 21/4035 |
| 2002/0091041 | A1 * | 7/2002 | Mantooth | A63B 21/4035 482/35 |
| 2011/0003666 | A1 * | 1/2011 | Raumann | A61H 15/00 482/79 |
| 2016/0361588 | A1 * | 12/2016 | Kuo | F03G 7/08 |
| 2017/0007876 | A1 * | 1/2017 | Lu | A63B 21/078 |

* cited by examiner

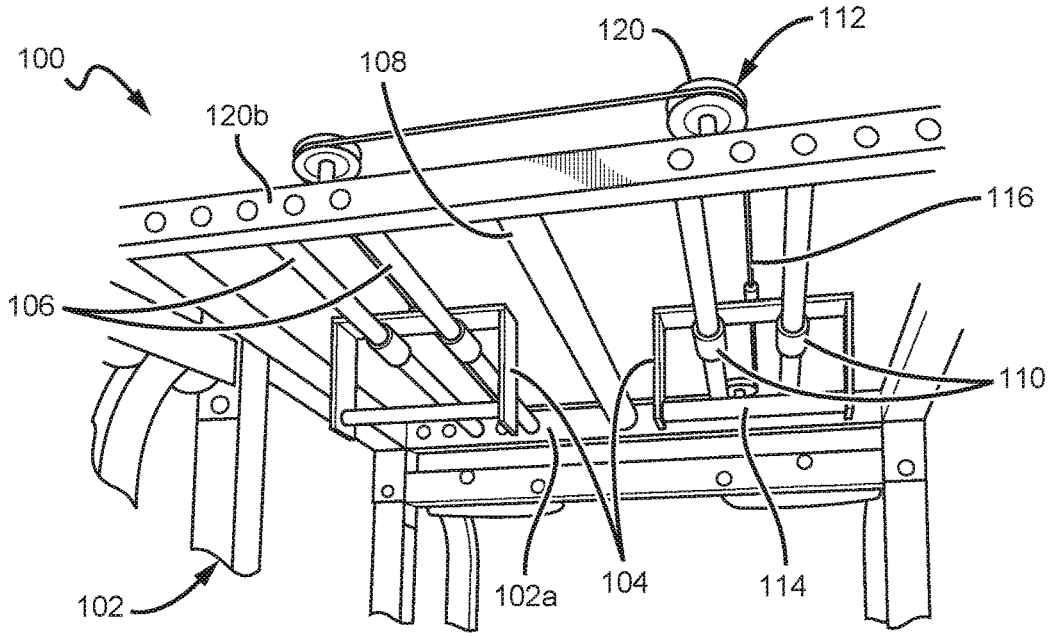
FIG. 3
FIG. 4
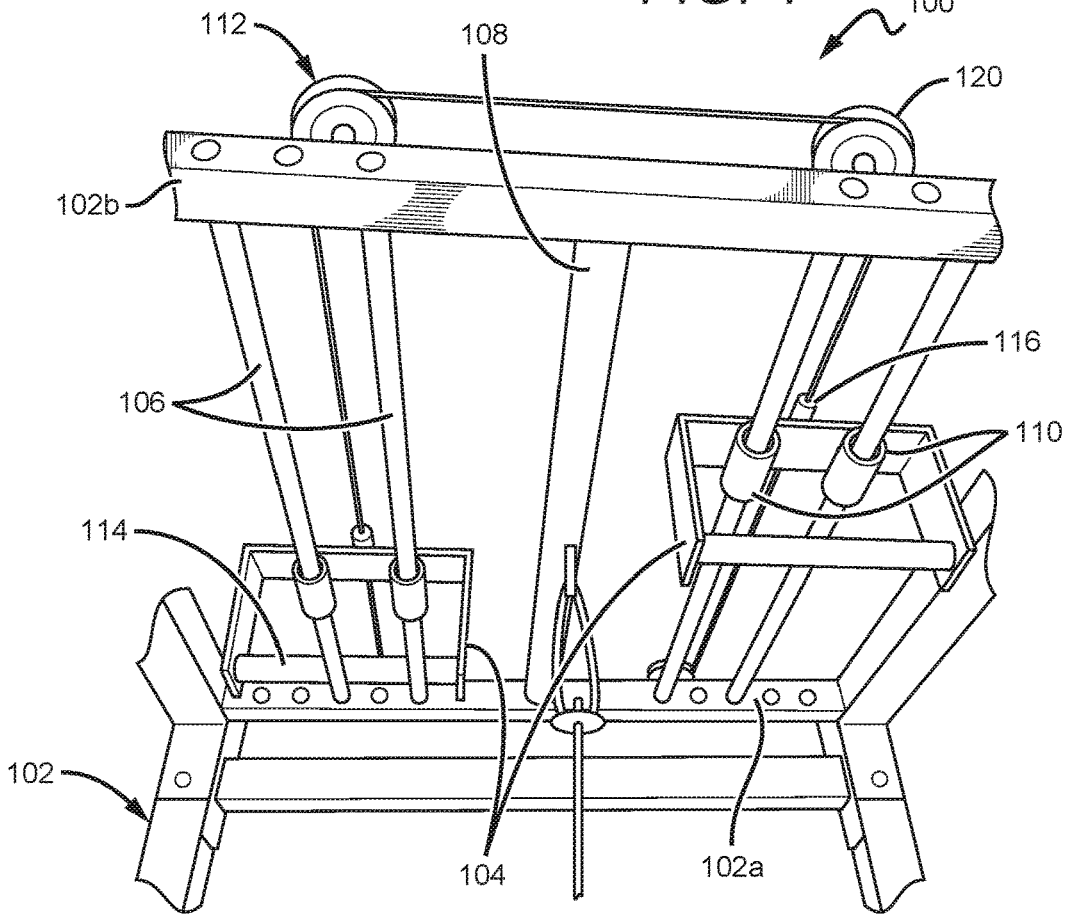

HAND-OVER-HAND FITNESS MACHINE AND METHODS OF USE

RELATED APPLICATION

This application claims the benefit of U.S. Provisional Application No. 62/691,527, filed on Jun. 28, 2018.

BACKGROUND OF THE DISCLOSURE

Field of the Disclosure

The disclosure relates generally to fitness machines, and, more particularly, to hand-over-hand fitness machines and methods of use thereof.

Description of the Related Art

A hand-over-hand climbing (HoH) device, sometimes referred to as "monkey bars" or a "jungle gym," is a piece of playground equipment made of many pieces of material, such as metal pipe or rope, on which participants can climb, hang, and swing from one rung to the next. These devices have been a staple piece of playground equipment since the 1920s. More recently HoH devices have become a popular piece of equipment in the fitness industry and can be found in gyms and cross training facilities throughout the world.

The typical HoH device provides a horizontal ladder structure with several rungs that span from one end of the device to the other. FIG. 1 shows a known HoH device. This particular device is at least ten feet in length, requiring significant space for use. When this device, or similar devices, are used for fitness purposes (e.g., sustained HoH activity) the user is required to make his way from end to end. Each time the user makes it to one end, she must turn around to face the opposite end of the device so that the bars may be traversed again.

These known HoH devices, such as the one shown in FIG. 1, suffer from several disadvantages. For example, a large amount of space is required to assemble and use the device. This is especially true when the user wants sustained movement in one direction to improve muscular endurance, requiring a device having more rungs and, thus, increased length. Another disadvantage is the need for the user to turn around when she reaches the last rung, breaking up the continuity of active motion.

Thus, there is a need for a device in the fitness industry that does not suffer from these and other drawbacks.

DESCRIPTION OF THE DRAWINGS

FIG. 3 is a close-up view of the handles and guide rails of the machine of FIG. 2.

FIG. 4 is another close-up view of the handles and guide rails of the machine of FIG. 2.

DESCRIPTION OF THE DISCLOSURE

The present invention is described herein with reference to certain embodiments, but it is understood that the invention can be embodied in many different forms and should not be construed as limited to the embodiments set forth herein.

It is understood that when an element can be referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Figure 1:
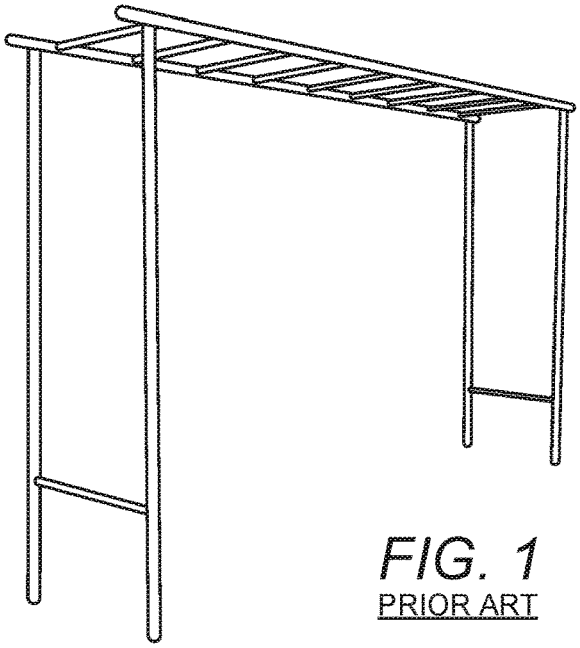
FIG. 1 PRIOR ART
FIG. 1 is a perspective view of a set of monkey bars, which is well-known in the art.
Figure 2:
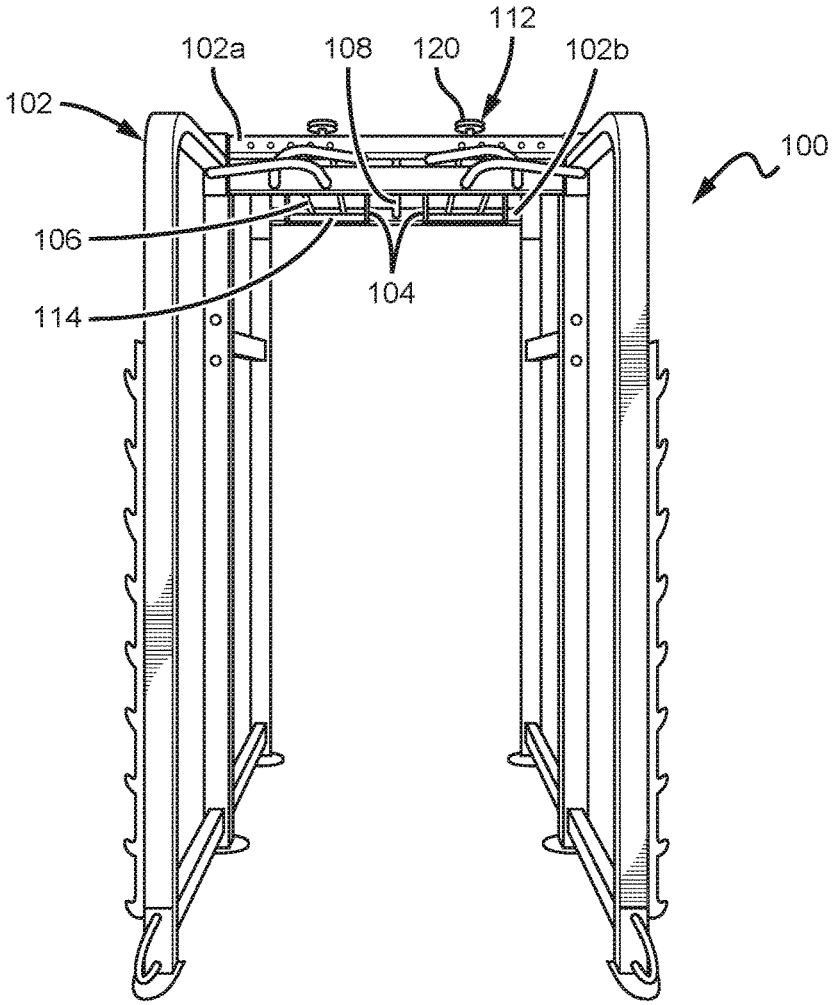
FIG. 2 is front elevation view of an exercise machine according to an embodiment of the present disclosure.
Figure 6A:
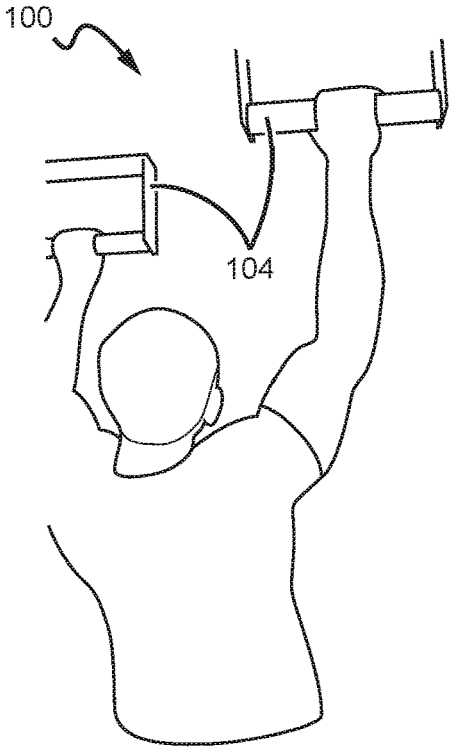
FIGS. 6*a*, 6*b* show a user operating the machine of FIG. 2.
Figure 6B:
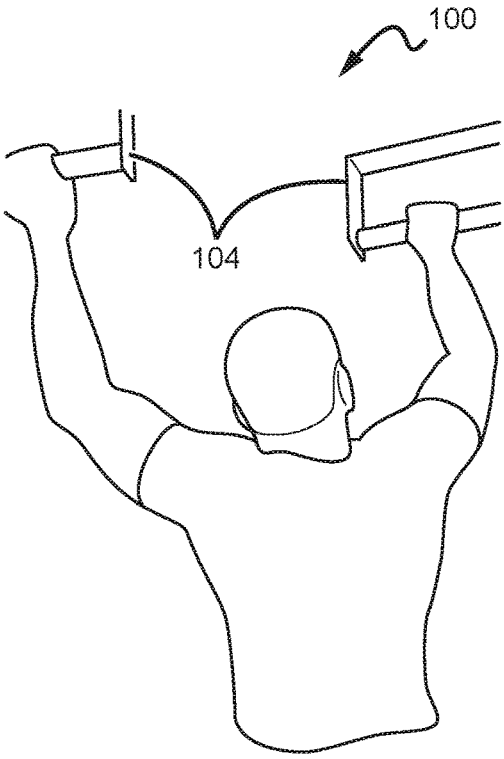

FIG. 2 is a front view of a fitness machine 100 according to an embodiment of the present disclosure. The machine 100 comprises a frame 102 and two handles 104 that slide forward and backward along two guide rails 106. In this particular embodiment, the guide rails 106 are connected to the frame 102 at a pair of support beams 102*a*, 102*b* in a parallel configuration on both sides of a center bar 108; however, in other embodiments the guide rails may be in a non-parallel configuration as shown herein with reference to FIGS. 12-21. The motion mimics the HoH action that a user experiences when traversing a set of monkey bars, as best shown in FIGS. 6*a* and 6*b*.

Embodiments of the machine 100 can be installed as a stand-alone piece of equipment, or they can be integrated with another machine, for example, a squat rack, a multi-purpose fitness machine, or a Smith machine. In either configuration, the machine 100 may be adjustable to accommodate users of varying height. For example, in one embodiment, the frame 102 may comprise vertical legs that telescope along a plurality of lockable positions, allowing the handles 104 to be raised and lowered as necessary.

FIGS. 3 and 4 are close-up views of the handles 104 and guide rails 106 of the machine 100. In this embodiment, there are two guide rails 106 for each handle 104. The handles 104 comprise a pair of sleeves 110 that allow the handles 104 to slide easily along the guide rails 106.

Figure 5:
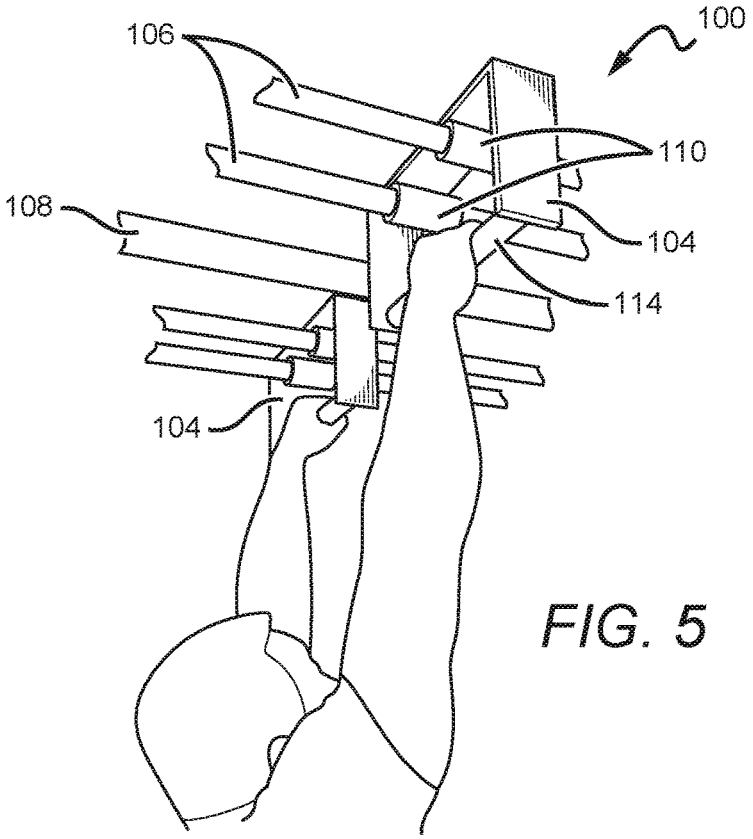
FIG. 5 shows a user hanging in a ready position with both hands grasping the handles in the machine of FIG. 2.

FIG. 5 shows a user hanging in a ready position with both hands grasping the handles 104. FIGS. 6*a* and 6*b* show the user using the machine 100. In FIG. 6*a*, the user's left hand is in a forward position, while the right hand is in a rear position. In FIG. 6*b*, the user's right hand is in the forward position, and the left hand is in the rear position. In one possible exercise, the user alternates the position of his hands, moving them in a back-and-forth fashion, to mimic the HoH swing-through motion necessary to traverse a set of monkey bars. The back-and-forth motion exercises the entire body, especially the upper body and the core. Many other exercises are possible, which may or may not require additional equipment or attachments.

Figure 7:
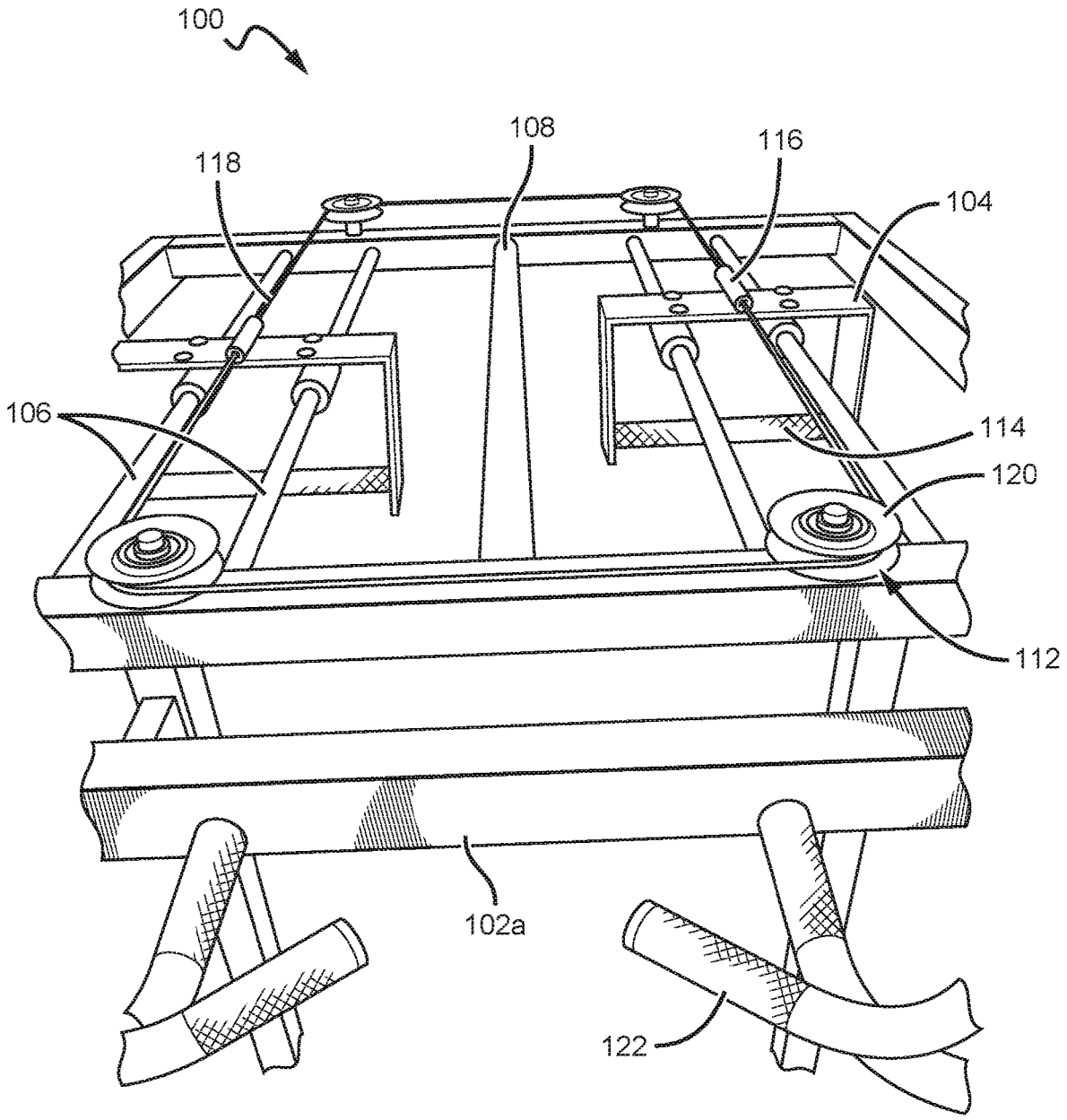
FIG. 7 shows a front side top perspective view of the machine of FIG. 2.

FIG. 7 shows a front side top perspective view of the machine 100. In this embodiment, a pulley system 112 is used to ensure that one handle 104 moves in a forward direction, while the other handle 104 simultaneously moves in a rearward direction. Thus, the pulley system 112 facilitates the proper alternating motion in one possible exercise. The handles 104 comprise a grip 114 where the user grasps the handle 104 and a wire connector 116 opposite the grip 114. The wire connector 116 engages with the wire 118 of the pulley system 112. As shown the wire 118 is disposed within grooves along a series of wheels 120. In this particular embodiment, the pulleys 112 simply change the direction of force of the wire 118 along the wire path such that the handles 104 are encouraged to move in a complementary fashion (i.e., one in a forward direction, the other in a backward direction). In other embodiments, different pulley configurations may be used to create a mechanical advantage if desired.

It is possible to utilize the pulley system 112 to provide additional resistance to the sliding motion of the handles 104, increasing the difficulty of this particular exercise. The resistance of the handle 104 motion may also be decreased (or even positively assisted) to facilitate the motion for those learning the exercise or for those having a lower fitness level. Thus, the machine 100 can be adjusted for use by users across a range of fitness levels.

Figure 8:
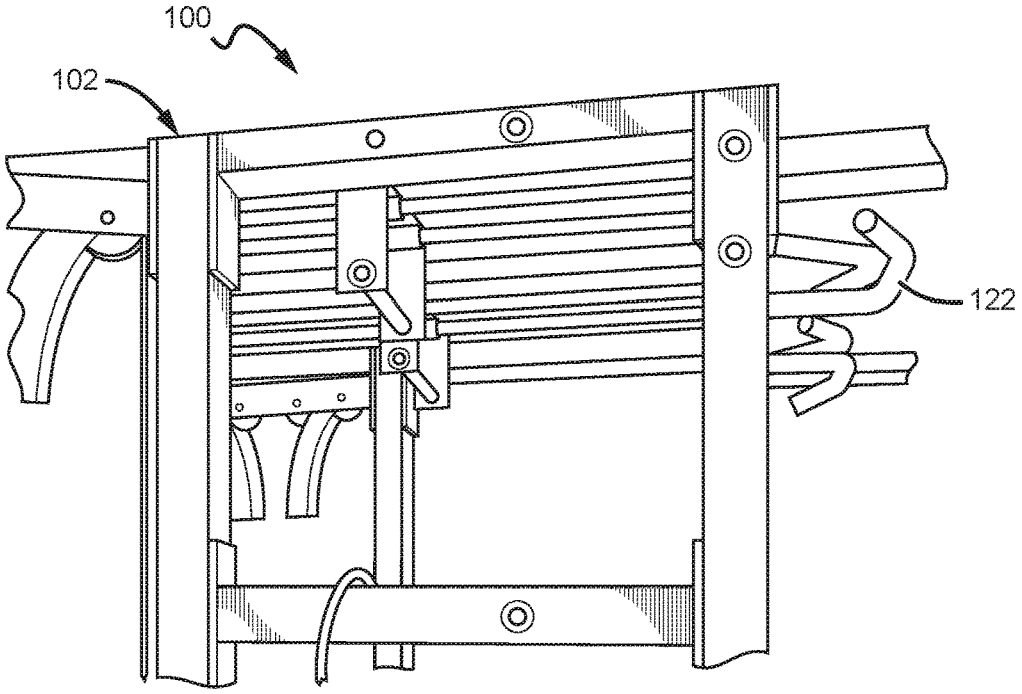
FIG. 8 shows a left side view of the machine of FIG. 2.

FIG. 8 shows a left side view of the machine 100. Additional positioning handles 122 are shown mounted to the frame 102. In other embodiments, positioning handles may be mounted at other locations, such as the support beams. Positioning handles 122 may be mounted to one or both ends of the machine 100 and may swing or rotate to allow the user to engage the handles 122 in several ways. These handles 122 may be used by a user to switch the direction that she is facing during exercise or, in the case of advanced users, to perform other tricks without breaking the flow of exercise by touching the ground.

Figure 9:
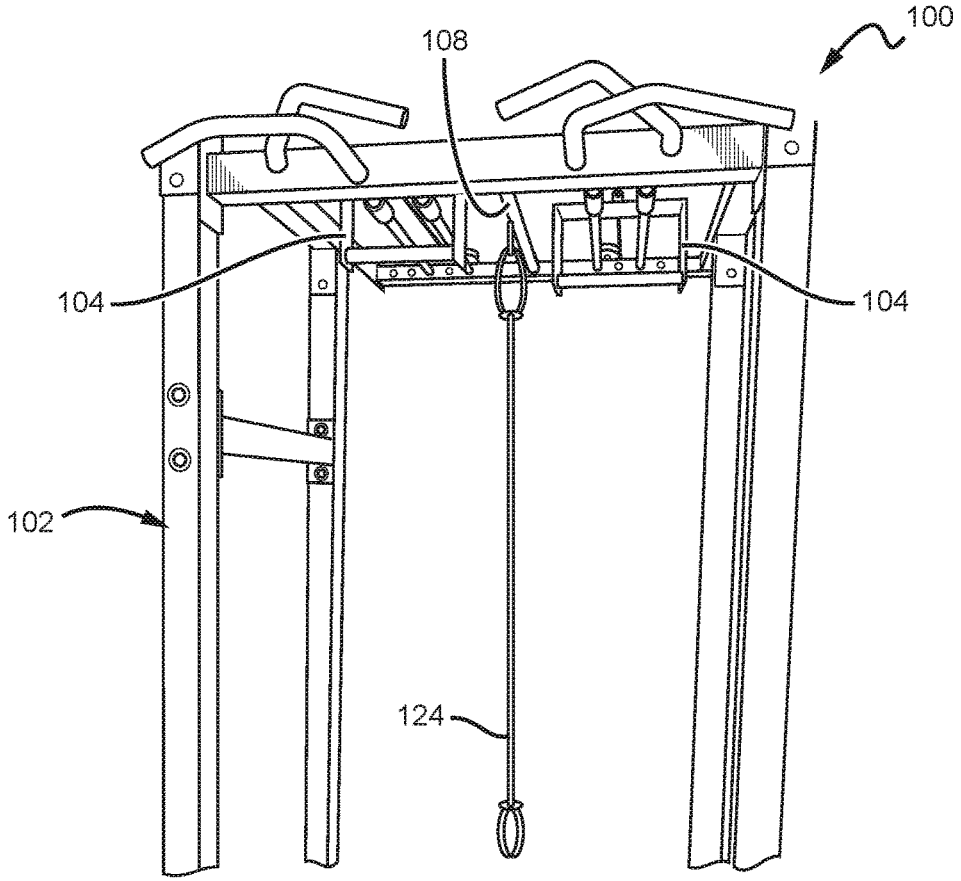
FIG. 9 is a front view of the machine of FIG. 2 with a resistance aid shown attached to a center bar.

FIG. 9 is a front view of the machine 100 with a resistance aid 124 shown attached to the center bar 108. The resistance aid 124 is designed to reduce the amount of weight that the user is forced to support during the exercise, allowing the user to exercise for longer intervals without stopping. Thus, users who are focused on aerobic cardio exercise may choose to use the resistance aid 124 for this purpose. The resistance aid 124 may be releasably attached to the machine 100 as shown, or it may be permanently integrated with the machine 100. In this embodiment, the resistance aid comprises a resistance band attachment 124 which is releasably attached to the center bar 108 such that a user can place her foot in the loop of the band 124 to effectively reduce the user's weight during exercise.

Figure 10:
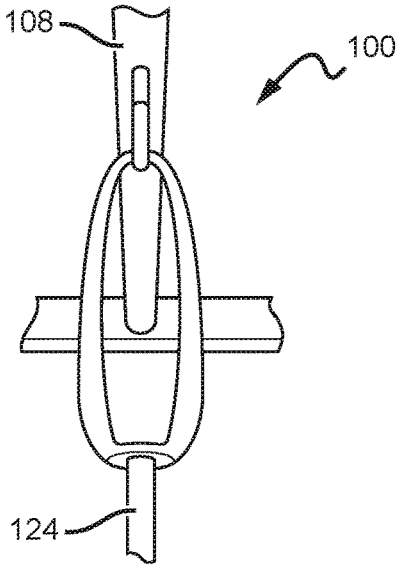
FIG. 10 is a close-up view of the resistance band attachment releasably attached to the center bar of the machine of FIG. 2.

FIG. 10 is a close-up view of the resistance band attachment 124 releasably attached to the center bar 108.

Figure 11:
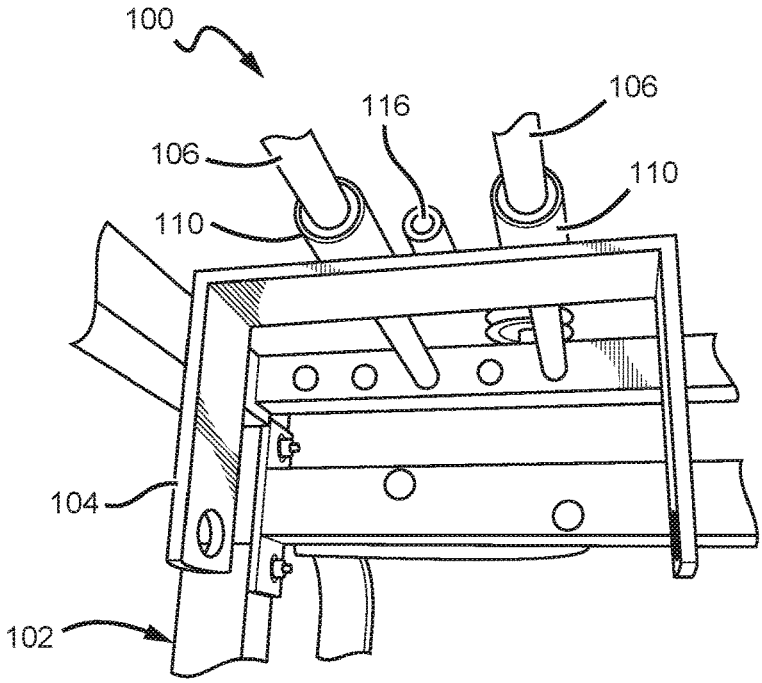
FIG. 11 is a close-up view of a sliding handle of the machine of FIG. 2.

FIG. 11 is a close-up view of the sliding handle 104. Here, the grip 114 is not shown in the handle 104 to illustrate that the grips 114 may be easily removed for customization, cleaning, and replacement. The sleeves 110 fit around the guide rail 106 to allow the handle 104 to slide in a controlled motion from one end of the guide rails 106 to the other end. In this view, the wire 118 has also been removed from the wire connector 116 on the top portion of the handle 104.

FIGS. 12-21 illustrate another embodiment of a fitness machine 200 that enables HoH exercises. The machine 200 operates similarly to and comprises many similar elements of the machine 100.

Figure 12:
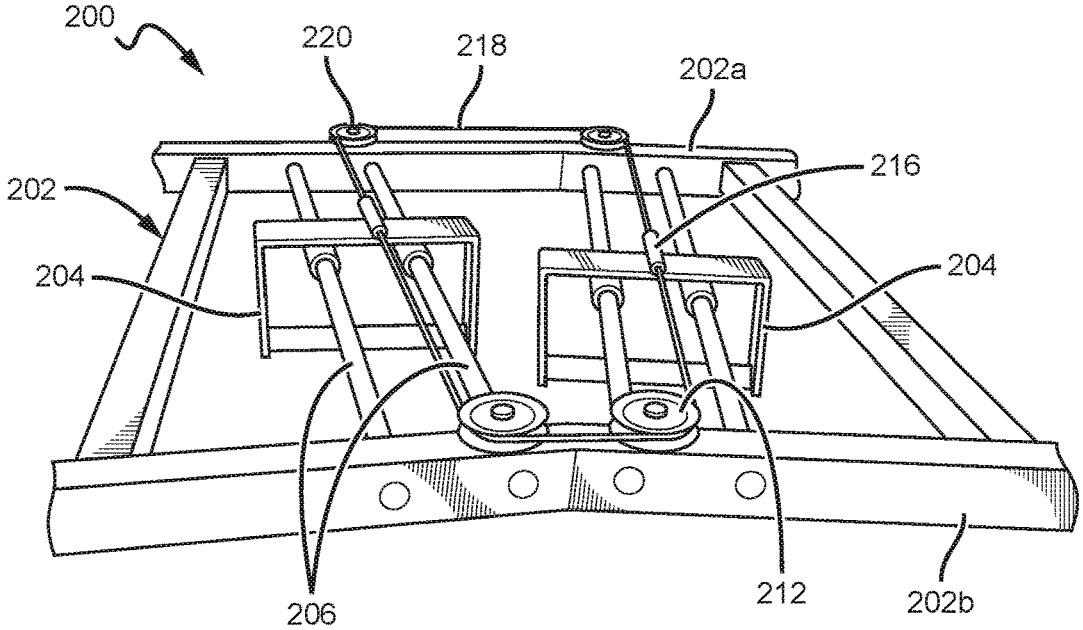
FIG. 12 is a back perspective view from a high angle of another embodiment of an exercise machine according to the present disclosure.

FIG. 12 is a back view of the machine 200 from a high angle. In this particular embodiment, the two sets of guide rails 206 are in a non-parallel configuration in a plane defined by the two guide rails 206. That is, the two pair of parallel guide rails 206 are angled with respect to one another to better mirror the natural swinging motion of the human body during HoH movements. The front and back support beams 202*a*, 202*b* may also be angled, as shown, such that the guide rails 206 can be connected to the support beams 202*a*, 202*b* in a perpendicular fashion. In this embodiment, a pulley system 212 is used to ensure that one handle 204 moves in a forward direction, while the other handle 204 simultaneously moves in a rearward direction. Thus, the pulley system 212 facilitates the proper alternating motion in one possible exercise. The distance between the corresponding pulley wheels 220 is adjusted accordingly. In one configuration, the guide rails 206 are spaced farther apart at the front of the machine 200 than they are at the back of the machine 200.

In one method of use of the machine 200, the user faces the front of the machine 200 where the guide rails 206 are spaced farther apart. During operation, the forward motion of the handle 204 takes the user's hand farther away from a centerline running from back to front and dividing the machine 200 in half. The backward motion of the handle 204 draws the user's hand toward the centerline. This angled guide rail provides a more natural path for the user's hands during operation and reduces unwanted stress on the user's shoulders by limiting handle movement along the path to a more comfortable range of motion.

In this embodiment, the angle between the guide rails 206 is permanently fixed. However, in other embodiments, this angle may be adjustable to accommodate users of different size and ability. Changing the angle between the rails 206 or the user orientation may also shift the focus of the exercise from one targeted muscle group to another.

Figure 13:
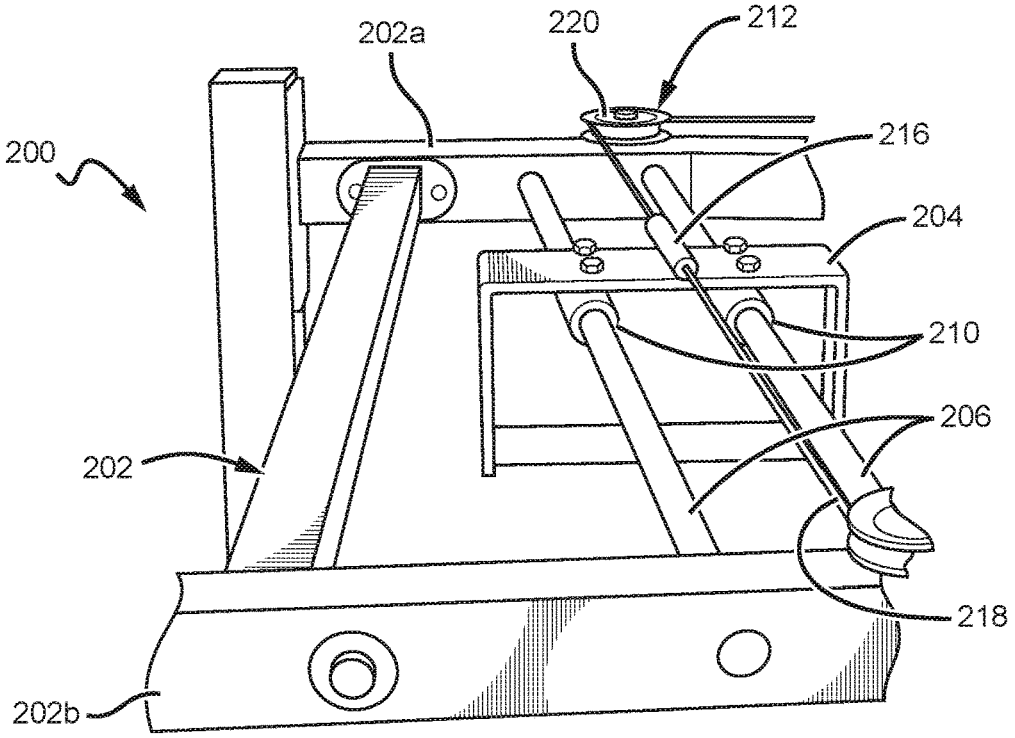
FIG. 13 is a close-up view of the left-side guide rail and handle from the top side of the machine of FIG. 12.

FIG. 13 is a close-up view of the left-side guide rail 206 and handle 204 from the top side of the machine 200.

Figure 14:
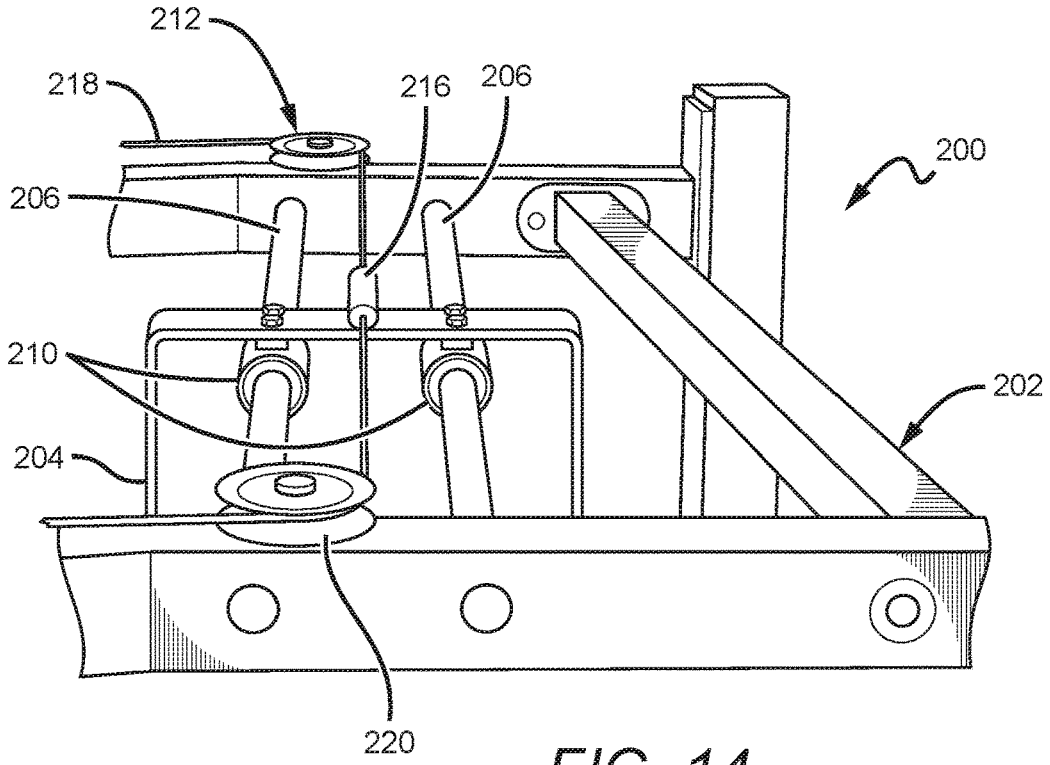
FIG. 14 is a close-up view of the right-side guide rail and handle from the top side of the machine of FIG. 12.

FIG. 14 is a close-up view of the right-side guide rail 206 and handle 204 from the top side of the machine 200.

Figure 15:
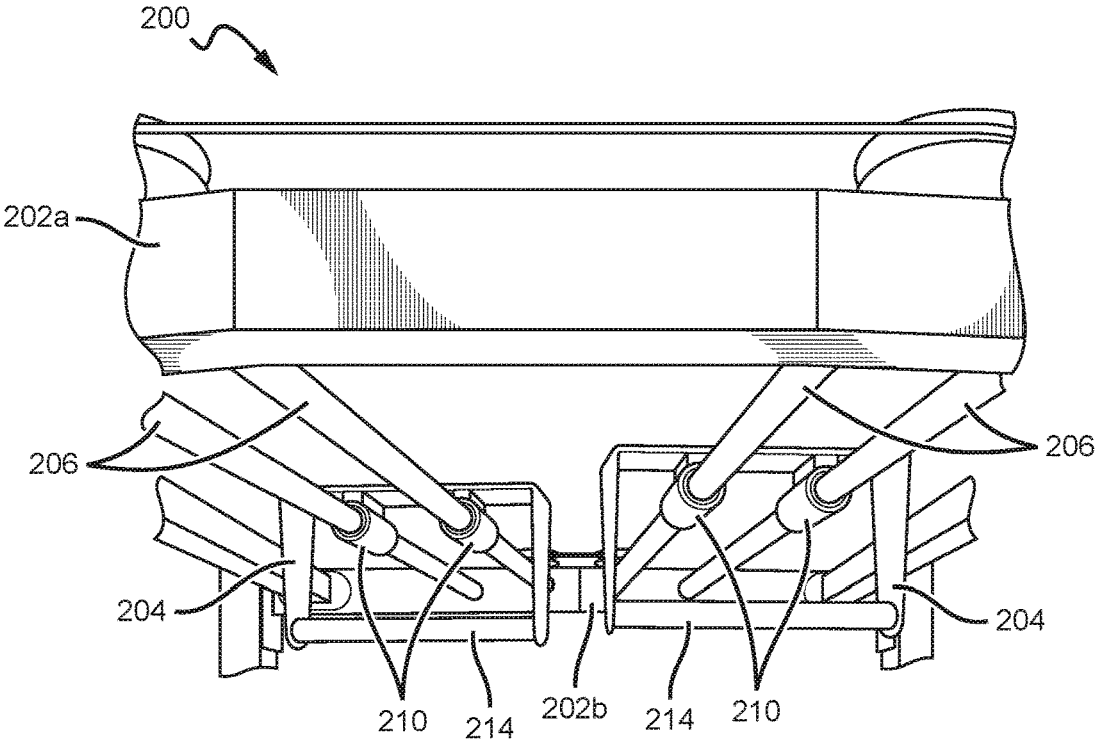
FIG. 15 is a front close-up view of a front support beam of the machine of FIG. 12.

FIG. 15 is a front close-up view of the front support beam 202*a*. As shown, the distance between guide rails 206 at the point where they connect to the front support beam 202*a* is greater than the distance where they connect to the back support beam 202*b*. The front support beam 202*a* is angled at two locations to accommodate a perpendicular connection with the angled guide rails 206.

Figure 16:
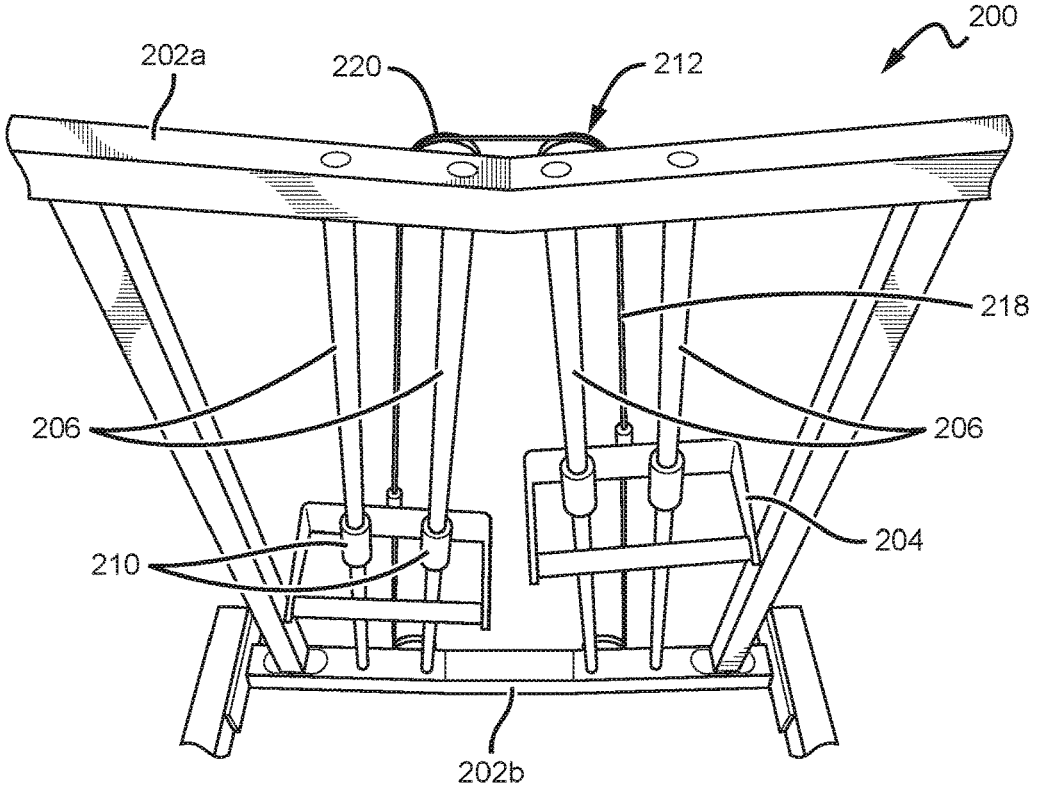
FIG. 16 is a view of the handles, guide rails, and support beams of the machine of FIG. 12 from the bottom side.

FIG. 16 is a view of the handles 204, guide rails 206, and support beams 202*a*, 202*b* from the bottom side.

Figure 17:
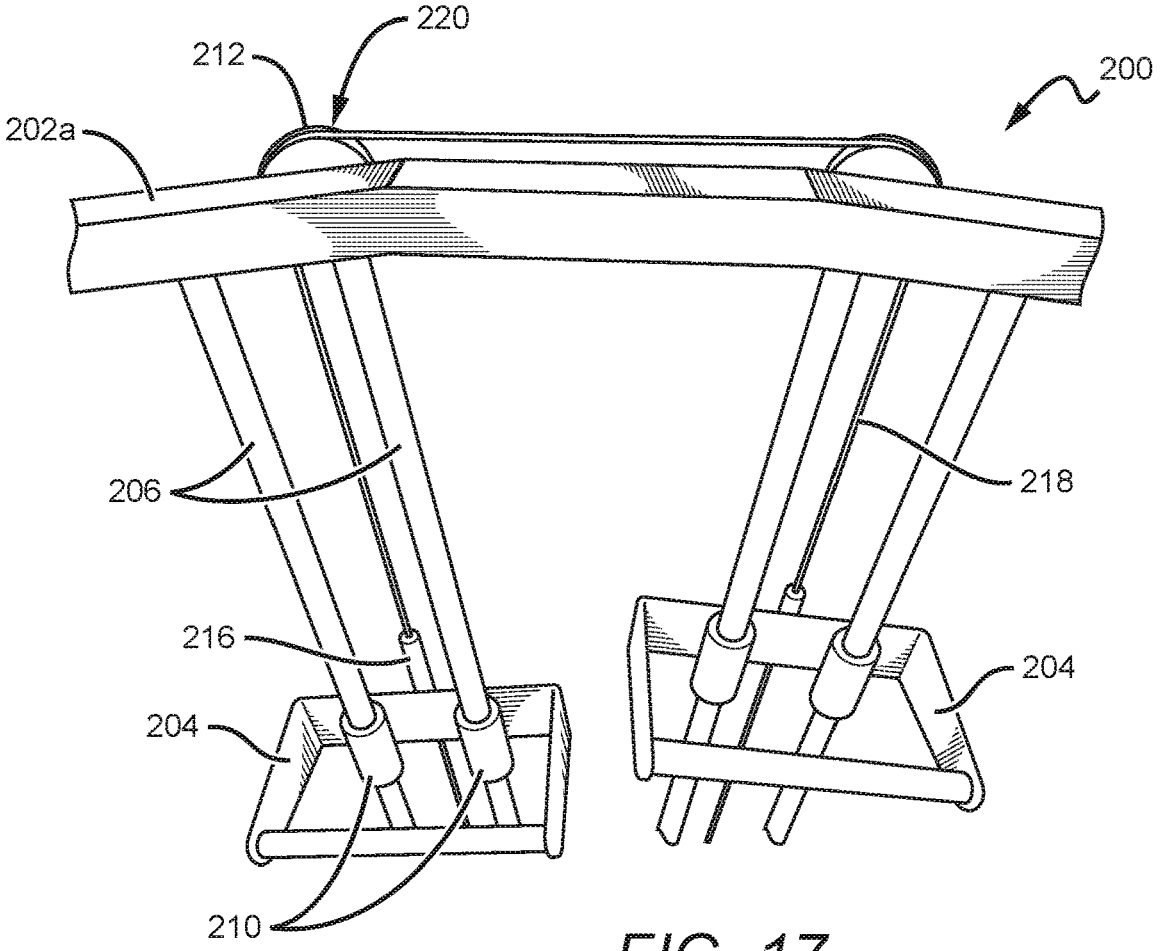
FIG. 17 is a view of the handles, guide rails, and the front support beam of the machine of FIG. 12 from the bottom side.

FIG. 17 is a view of the handles 204, guide rails 206, and the front support beam 202*a* from the bottom side.

Figure 18:
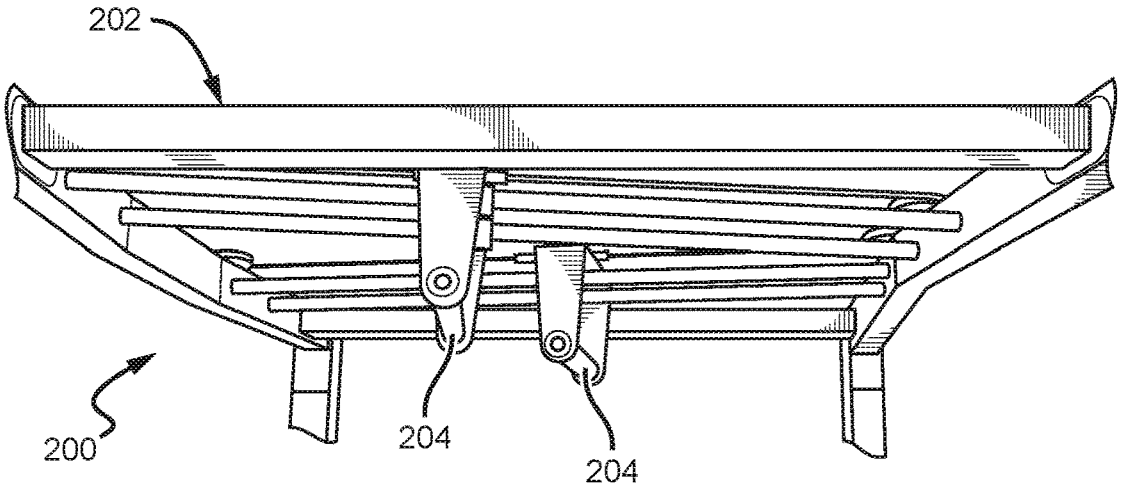
FIG. 18 is a view of the top portion of the machine of FIG. 12 from the right side.

FIG. 18 is a view of the top portion of the machine 200 from the right side.

Figure 19:
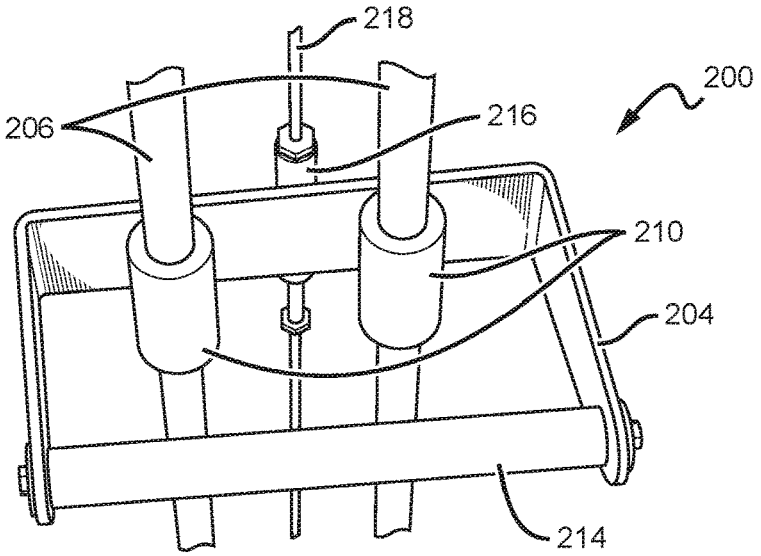
FIG. 19 is a close-up view of one of the handles and the associated guide rails of the machine of FIG. 12.

FIG. 19 is a close-up view of one of the handles 204 and the associated guide rails 206. The pulley wire 218 is shown attached to the wire connector 216 on the handle 204 opposite the grip 214.

Figure 20:
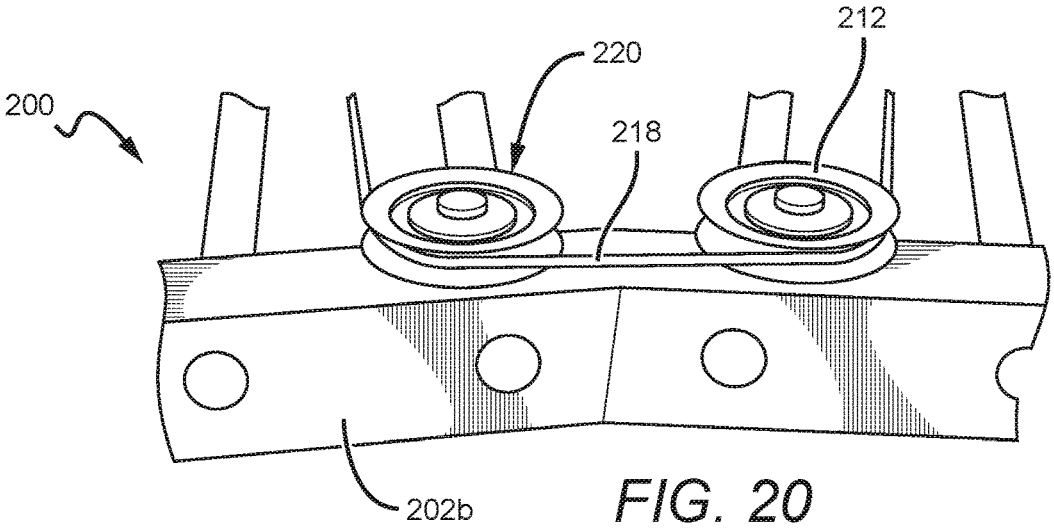
FIG. 20 is a close-up view of the pulley wheels on the back support beam of the machine of FIG. 12.

FIG. 20 is a close-up view of the pulley wheels 220 on the back support beam 202*b*. The wheels 220 on the back side of the machine 200 are spaced more closely than their counterparts on the front side. The back support beam 202*b* is angled to accommodate a perpendicular connection with the guide rails 206.

Figure 21:
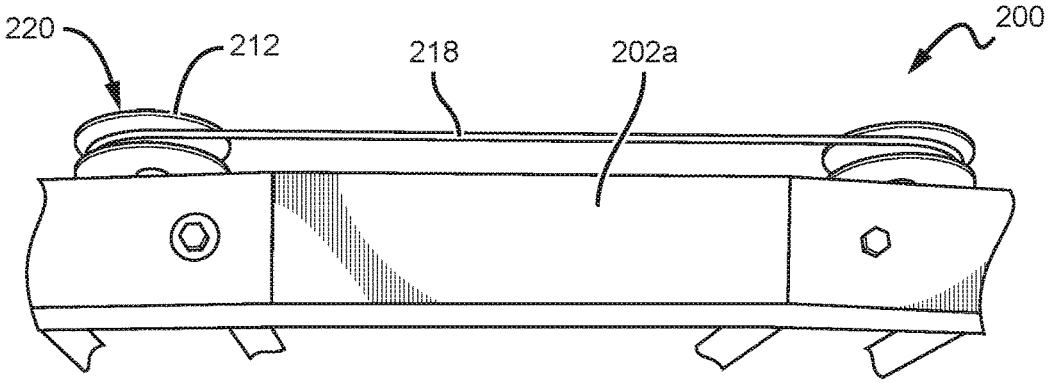
FIG. 21 is a close-up view of the pulley wheels on the front support beam of the machine of FIG. 12.

FIG. 21 is a close-up view of the pulley wheels 220 on the front support beam 202*a* which are spaced farther apart than the pulley wheels 220 on the back support beam 202*b*.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

We claim:

1. An exercise machine, comprising:

a frame configured to rest on a floor, said frame comprising first and second opposing support beams;

at least one right-side guide rail and at least one left-side guide rail, said at least one right-side guide rail and said at least one left-side guide rail spanning between said first and second support beams;

a right handle configured to slide back and forth along a length of said at least one right-side guide rail between said first and second support beams in a first plane of motion that is parallel to said floor; and a left handle configured to slide back and forth along a length of said at least one left-side guide rail between said first and second support beams in said first plane of motion, wherein said right handle and said left handle are configured to allow a user to hang underneath both of said at least one right-side guide rail and said at least one left-side guide rail during operation of said exercise machine, and wherein said right handle moves along a first linear path within said first plane of motion and said left handle moves along a second linear path within said first plane of motion, wherein said first linear path and said second linear path are non-parallel.

2. The exercise machine of claim 1, further comprising a pulley system connected to said frame and said right and left handles, wherein said pulley system is configured to encourage said right handle to move in a forward direction when said left handle moves in a backward direction, and vice versa, during operation of said exercise machine.

3. The exercise machine of claim 2, wherein said pulley system is configured to be adjusted to resist or assist in the sliding motion of said right and left handles during operation of said exercise machine.

4. The exercise machine of claim 1, further comprising a resistance aid attached to said frame and configured to reduce an amount of weight that the user is forced to support during operation of said exercise machine.

5. The exercise machine of claim 4, wherein said resistance aid comprises an elastic band releasably fastened to an upper portion of said frame.

6. The exercise machine of claim 1, wherein said at least one right-side guide rail comprises two parallel right-side guide rails, and said at least one left-side guide rail comprises two parallel left-side guide rails.

7. The exercise machine of claim 1, wherein a height of said right and left handles above said floor is adjustable.

8. The exercise machine of claim 1, further comprising at least one positioning handle mounted to one of said first and second support beams opposite said at least one right-side and at least one left-side guide rails.

9. An exercise machine, comprising:

a frame configured to rest on a floor, said frame comprising a front support beam and a rear support beam;

a plurality of guide rails spanning between said front support beam and said rear support beam in a non-parallel configuration in a plane defined by said plurality of guide rails;

a right handle configured to slide back and forth along a length of at least one of said plurality of guide rails between said front and rear support beams in a first plane of motion that is parallel to said floor; and a left handle configured to slide back and forth along a length of at least one of said plurality of guide rails between said front and rear support beams in said first plane of motion, wherein said right handle and said left handle are configured to allow a user to hang underneath each of said plurality of guide rails during operation of the exercise machine, and wherein said right handle moves along a first linear path within said first plane of motion and said left handle moves along a second linear path within said first plane of motion, wherein said first linear path and said second linear path are non-parallel.

10. The exercise machine of claim 9, further comprising a pulley system connected to said frame and said right and left handles, wherein said pulley system is configured to encourage said right handle to move in a forward direction when said left handle moves in a backward direction, and vice versa, during operation of said exercise machine.

11. The exercise machine of claim 10, wherein said pulley system is configured to be adjusted to resist or assist in the sliding motion of said right and left handles during operation of said exercise machine.

12. The exercise machine of claim 9, further comprising a resistance aid attached to said frame and configured to reduce an amount of weight that the user is forced to support during operation of said exercise machine.

13. The exercise machine of claim 12, wherein said resistance aid comprises an elastic band releasably fastened to an upper portion of said frame.

14. The exercise machine of claim 9, wherein said plurality of guide rails comprises at least two parallel right-side guide rails and at least two parallel left-side guide rails, wherein said at least two parallel right-side guide rails are in said non-parallel configuration with said at least two parallel left-side guide rails.

15. The exercise machine of claim 9, wherein a height of said right and left handles above said floor is adjustable.

* * * * *